US005236574A

United States Patent [19]

Oshima et al.

[11] Patent Number: 5,236,574

[45] Date of Patent: Aug. 17, 1993

[54] ELECTROPLATING OF HOT-GALVANIZED STEEL SHEET AND CONTINUOUS PLATING LINE THEREFOR

[75] Inventors: Kazuhide Oshima; Hisakazu Morino; Tomio Kondo, all of Wakayama; Yasuo Shimada, Sennan; Tadashi Nonaka, Wakayama; Hiroshi Oishi, Wakayama; Yoshikazu Yamanaka, Wakayama; Yoshihiko Hoboh, Osaka; Atsuhisa Yakawa, Nishinomiya, all of Japan

[73] Assignee: Sumitomo Metal Industries, Ltd., Osaka, Japan

[21] Appl. No.: 519,649

[22] Filed: May 7, 1990

[30] Foreign Application Priority Data

May 8, 1989 [JP] Japan ..... 1-114791
Nov. 21, 1989 [JP] Japan ..... 1-302562

[51] Int. Cl.[5] ..... C25D 7/06
[52] U.S. Cl. ..... 205/138; 204/207
[58] Field of Search ..... 204/28, 32.1, 38.4

[56] References Cited

FOREIGN PATENT DOCUMENTS 2565255 12/1985 France .
194091 10/1985 Japan .
60-224791 11/1985 Japan .
61-48592 3/1986 Japan .
1108396 4/1989 Japan .
417411 10/1934 United Kingdom .

OTHER PUBLICATIONS

6001 Chemical Abstracts, vol. 97 (1982) November, No. 20, Columbus, Ohio (Abstract No. 171344X).

*Primary Examiner*—T. M. Tufariello
*Attorney, Agent, or Firm*—Burns, Doane, Swecker & Mathis

[57] ABSTRACT

A continuous multi-layer plating line for steel sheet which includes a hot-galvanizing apparatus to form a galvanized coating and optionally to alloy the coating and an electroplating apparatus to form an electroplated coating on the galvanized coating. Between the hot-galvanizing apparatus and the electroplating apparatus, a post-galvanizing surface treatment apparatus effective for removing surface oxide contaminants and activating the surface of the galvanized coating is disposed and the galvanized steel sheet is treated thereby prior to electroplating. The post-galvanizing surface treatment may be carried out by applying an alkali solution or an acid which can dissolve aluminum oxide to the galvanized coating, by alkali electrolysis, by cathodic electrolysis, by cooling the galvanized steel sheet with an alkali solution, or by skin-pass rolling using an alkali solution or an acid which can dissolve aluminum oxide as a skin-pass roling liquid.

13 Claims, 3 Drawing Sheets

ELECTROPLATING OF HOT-GALVANIZED STEEL SHEET AND CONTINUOUS PLATING LINE THEREFOR

BACKGROUND OF THE INVENTION

This invention relates to a plating method for steel sheet. More particularly, it relates to an electroplating method of hot-galvanized steel sheet. It also relates to a plating line in which a steel sheet is continuously subjected to hot-galvanizing and then electroplating. The resulting plated steel sheet has an electroplated top coating with excellent covering power and adhesion to the underlying hot-galvanized coating.

In the automotive and construction industries, there is always a great demand for materials having good corrosion resistance and a long life span. In particular, the corrosion resistance demanded of rust-preventive steel sheets for automobile bodies has become extreme.

In order to meet these demands, various new types of electroplated steel sheets have been proposed, such as steel sheets electroplated with a Zn-Ni, Zn-Fe, or Zn-Mn alloy, steel sheets hot-dip plated with a Zn-Fe, Zn-Al-Si, or Zn-Al-Mg alloy. Steel sheet having multiple plated layers in which the top layer is an Fe-rich (Fe≧60%) Fe-Zn alloy plated coating has also been developed with the intention to improve the coatability of the plated steel sheet by cationic electrodeposition performed thereon and to increase the adhesion of the electrodeposited coating in water (see Japanese Published Unexamined Patent Application No. 56-133488).

Steel sheet with a plurality of layers of plated coating (hereinafter referred to as multi-layer plated steel sheet) is highly suitable for use in automobiles and as a construction material not only on account of its coatability but also because of its excellent press forming characteristics (sliding properties), weldability, and various other properties.

The multi-layer electroplating that have been proposed in the prior art include a Zn-Ni/Fe or Fe-Zn coating (Japanese Published Examined Patent Application No. 60-57518), a Zn-Ni/Zn or Zn-Ni or Zn-Fe/Cr(Cr-oxide) coating (Japanese Published Unexamined Patent Application No. 60-197893), a Zn-Mn/Zn-Fe coating (Japanese Published Unexamined Patent Application No. 58-42787), and a Zn or Zn alloy/minute particle-dispersed Zn or Zn alloy coating (Japanese Published Unexamined Patent Application No. 62-230999).

Recently, it has also been proposed to perform electroplating on an alloyed hot-galvanized steel sheet (Japanese Published Unexamined Patent Applications Nos. 56-133488 and 61-253397).

When forming multi-layer electroplated coating using a single electroplating line, normally, plating baths for different types of coatings are arranged in series along the line. Equipment for dip water rinsing and, if necessary, equipment for rinsing with hot water or with brushes is installed between successive baths. However, no treatment other than rinsing or scrubbing is performed on the steel sheet as it is passed from one bath to another.

Similarly, when a steel sheet is hot-galvanized and then electroplated in a continuous process, equipment for continuous electroplating is simply connected in series with equipment for continuous hot-galvanizing, and no special treatments are performed on the steel sheet as it travels between the two sets of equipment.

For example, Japanese Published Unexamined Patent Application No. 60-224791 discloses a continuous plating apparatus in which a pretreatment apparatus, a hot-galvanizing bath, an alloying furnace, and an electroplating apparatus are connected in series. A skin-pass rolling mill and, if necessary, a water rinse tank may be disposed between the hot-galvanizing bath and the electroplating apparatus.

Japanese Published Unexamined Patent Application No. 62-17200 discloses a continuous one-sided plating apparatus in which a pretreatment apparatus, a hot-galvanizing bath for plating one side of a steel sheet, an alloying furnace, a cleaning apparatus for cleaning the unplated side of the sheet, and an electroplating apparatus are connected in series.

In these continuous plating apparatuses, no special chemical treatment is performed on the hot-dipped coating of the sheet before electroplating.

However, the present inventors' research has shown that when two different processes, such as hot-galvanizing and electroplating, are arranged in sequence, the following problems occur.

(1) If continuous electroplating is performed after hot-galvanizing of a steel sheet, electroplated coatings such as a Fe or Fe-based alloy (Fe-Zn, etc.), Cr(Cr-oxide), Ni, and Zn-Ni alloy coatings have poor adhesion to the galvanized coating, and these coatings tend to readily peel off either while the coated sheet is still flat or after it has been subjected to working (bending, drawing, etc.).

(2) If a hot-galvanized steel sheet is heated to perform alloying of the galvanized coating prior to electroplating, the resulting alloyed galvanized coating has microscopic surface irregularities, i.e., bumps and depressions, which are inherent in an alloyed galvanized steel sheet (usually called GA steel sheet). The irregularities include those which are caused by the crystalline form of the Zn-Fe alloy and microscopic depressions which are formed during alloying. They generally have a size of 3–20 micrometers.

Such microscopic surface irregularities, and particularly the depressions, cannot be adequately covered by the overlaid electroplated coating. When the electroplated coating is one such as an Fe coating which is intended to increase the coatability of the plated steel sheet by cationic electrodeposition, the electroplated coating cannot adequately perform its intended function.

The covering power of an electroplated coating with respect to microscopic irregularities will hereunder be referred to as its microcovering power.

Thus, it is not possible to achieve a hot-galvanized electroplated steel sheet of high quality simply by connecting a continuous hot-galvanizing apparatus and a continuous electroplating apparatus in sequence.

SUMMARY OF THE INVENTION

Accordingly, it is an object of the present invention to provide a plating line for performing continuous galvanizing and electroplating of steel sheet which can form an electroplated coating having excellent microcovering power.

It is another object of the present invention to provide a continuous plating line of steel sheet in which conventional hot-galvanizing and electroplating equipment is used.

It is a further object of the present invention to provide a method for electroplating a galvanized steel sheet to form an electroplated coating having excellent microcovering power.

It is a still further object of the present invention to provide a continuous galvanizing and electroplating method which can be performed in a single plating line to form a hot-galvanized electroplated steel sheet of high quality.

According to the method of the present invention, a hot-galvanized steel sheet is subjected to post-galvanizing surface treatment prior to electroplating in order to remove oxide and other surface contaminants (hereinafter collectively referred to as surface oxide contaminants) and activate the surface of the galvanized coating.

The post-galvanizing surface treatment employed in the present invention greatly increases the adhesion and covering power of an electroplated coating. The reasons for these improvements are not yet clear. However, it is thought that the surface treatment improves properties by dissolving away aluminum oxide and an Zn-containing aluminum oxide which are formed on the surface of a galvanized coating of a steel sheet by the heat applied by hot-galvanizing or alloying and which have poor electrical conductivity. Furthermore, it can remove Al and other metallic contaminants which segregates on the surface and which are thought to influence electro-deposition of an electroplated coating.

The post-galvanizing surface treatment can be any form of treatment which can remove surface oxide contaminants which adversely affect the microcovering power of an electroplated coating. The surface treatment may be carried out by applying a strong alkali solution or an acid which can dissolve aluminum oxide to the surface of the galvanized coating. Alternatively, it can be performed by electrolysis such as cathodic or anodic electrolysis in an alkaline solution (alkali electrolysis) or cathodic electrolysis in a neutral solution. The post-galvanizing surface treatment can also be performed by skin-pass rolling using a strong alkali solution or an acid which can dissolve aluminum oxide as a skin-pass rolling liquid or by cooling a hot galvanized or alloyed steel sheet with an alkali solution as a cooling medium before skin-pass rolling.

A continuous plating line according to the present invention comprises a continuous hot-galvanizing apparatus for forming a galvanized coating on a steel strip which is optionally equipped with an alloying apparatus, a continuous electroplating apparatus connected in series with the hot-galvanizing apparatus for forming an electroplated coating on the galvanized coating, and at least one post-galvanizing surface treatment apparatus disposed between the hot-galvanizing apparatus and the electroplating apparatus for removing surface oxide contaminants and activating the surface of the galvanized coating.

For example, the post-galvanizing surface treatment apparatus can be a device for spraying a steel strip with a surface treatment solution such as a strong alkali solution or an acid which can dissolve aluminum oxide, an immersion bath using such a surface treatment solution, an electrolytic cell, a cooling tank using an alkali solution as a cooling medium which is disposed before a skin-pass rolling mill, or a skin-pass rolling mill employing a strong alkali solution or an acid which can dissolve aluminum oxide as a skin-pass rolling liquid.

DETAILED DESCRIPTION OF THE INVENTION

The present invention will be described in greater detail while referring to the accompanying drawings. The drawings illustrate embodiments of the plating line of the present invention having an alloying furnace after the hot-galvanizing bath. However, an alloying step is optional and the present invention is not limited to such embodiments.

Figure 1:
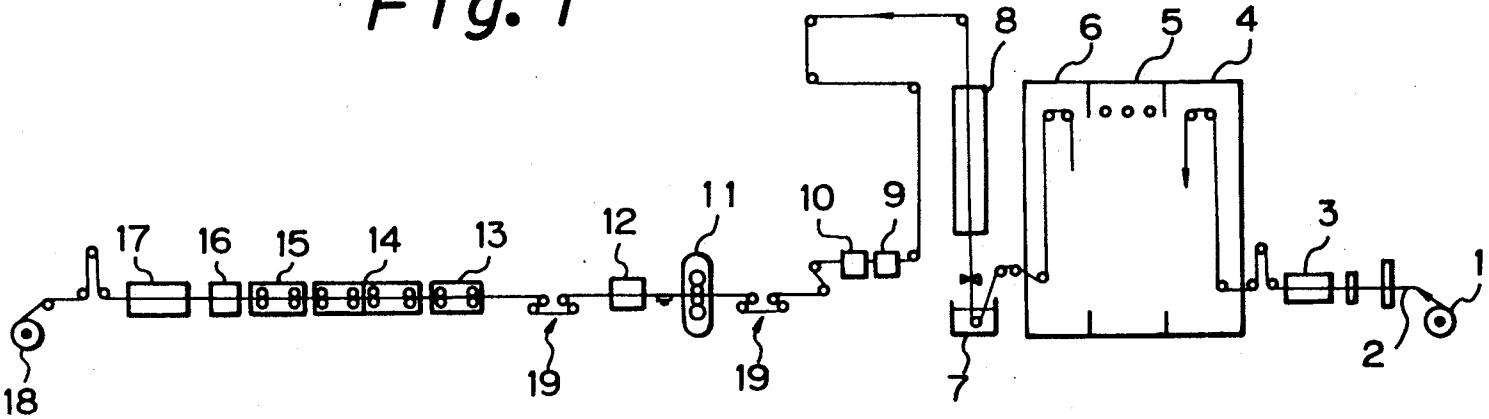
FIG. 1 is a schematic illustration of an embodiment of a continuous plating line according to the present invention.

FIG. 1 schematically illustrates a continuous plating line according to the present invention.

As shown in this figure, a steel strip 2 is unwound from a pay-off reel 1 and passed through a prewashing apparatus 3 and then through a pretreatment apparatus comprising a rapid heating furnace 4, a reduction furnace 5, and a cooling furnace 6 in which the surface of the steel strip is cleaned. If necessary, the strip 2 can be annealed. It is then passed through a hot-galvanizing bath 7 where hot galvanizing is carried out and a galvanizing coating is formed on one side or both sides of the strip. Then, if necessary, the strip 2 is passed through an alloying furnace 8 in which Fe in the steel strip 2 and Zn in the hot-galvanized coating are alloyed.

The hot-galvanizing bath 7 can be a bath of either zinc or a zinc alloy such as GALFAN [5% Al, 0.1% (La+Ce), the remainder Zn], GALVALUME (55% Al, 1.5% Si, the remainder Zn), or the like.

The optionally alloyed galvanized steel strip 2 is then passed through a post-galvanizing surface treatment apparatus 9, which removes surface oxide contaminants and activates the surface of the galvanized coating. In the present embodiment, the surface treatment apparatus comprises a tank containing a strong alkali solution (pH at least 12) in which the strip 2 is immersed. The strip 2 is then washed with a water scrubber 10 or similar water rinsing apparatus and passed through bridle rolls 19, a skin-pass rolling mill 11, and a leveller 12 to flatten the surface and remove strains. The strip 2 is then passed through a pretreatment tank 13 and an electroplating cell 14, in which electroplating is performed on the galvanized coating. It is next rinsed with water in a water scrubber 15 and then dried in a drier 16. Then, if necessary, finishing treatment such as chromate treatment can be performed in a finishing surface treatment apparatus 17, and the treated steel strip 2 is wound onto a tension roll 18.

The location of the post-galvanizing surface treatment apparatus 9 (and the water scrubber 10) in the plating line is not critical. For example, it can be disposed between the leveller 12 and the bridle rolls 19, in which case the post-galvanizing surface treatment is performed after skin-pass rolling instead of before.

Furthermore, more than one post-galvanizing surface treatment apparatus 9 can be employed. For example, an additional post-galvanizing surface treatment apparatus 9 and water scrubber 10 can be disposed between the leveller 12 and the bridle rolls 19, in which case the post-galvanizing surface treatment is performed both before and after skin-pass rolling.

The position of the skin-pass rolling mill 11 is also not critical. For example, the skin-pass rolling mill 11 and the leveller 12 can be disposed between the drier 16 and the surface treatment apparatus 17, in which case skin-pass rolling is performed subsequent to electroplating.

Furthermore, as mentioned previously, the post-galvanizing surface treatment apparatus 9 is not limited to an immersion tank, and it can be any device which is capable of removing oxide contaminants from the surface of the galvanized coating of the steel strip 2 and improving the adhesion of an electroplated coating deposited thereon. For example, it can be a spraying apparatus, an electrolytic cell, or a skin-pass rolling mill using a suitable post-galvanizing surface treatment solution as a skin-pass rolling liquid.

The operation of the embodiment illustrated in FIG. 1 will now be described.

First, if necessary, a steel strip 2 is washed in the prewashing apparatus 3 using an alkali solution or other suitable rinse solution. It is then subjected to surface cleaning and, if necessary, annealing in the pretreatment apparatus which consists of the rapid heating furnace 4, the reduction furnace 5, and the cooling furnace 6.

In the cooling furnace 6, the temperature of the cleaned and optionally annealed steel strip 2 is adjusted to a level suitable for hot-galvanizing, after which one or both sides of the strip 2 are galvanized in a hot-galvanizing bath 7 containing molten Zn or a molten Zn alloy to form a galvanized coating. The coating weight is adjusted to a prescribed level by a gas wiping device disposed directly above the galvanizing bath 7. The galvanized coating is then alloyed by heating in the alloying furnace 8. Any type of alloying furnace 8 can be employed, such as a gas-heated furnace, an electromagnetic induction furnace, or a laser heating furnace. The degree of alloying is controlled by adjusting the temperature and the heating time.

In the manufacture of rust-preventive steel sheet for automobiles, the galvanized coating typically has a Zn coating weight of 30–80 g/m$^2$ and it can be alloyed into a Zn-Fe alloy containing 7–12% Fe. When alloying is not performed, the steel strip 2 can be simply passed through the alloying furnace without alloying treatment.

The surface of the resulting galvanized steel strip 2 is then subjected to post-galvanizing surface treatment in the treatment apparatus 9. According to one form of the present invention, the post-galvanizing surface treatment is performed with a strong alkali solution by immersion or spraying.

Useful alkali solutions include sodium hydroxide, sodium silicate (ortho or meta), sodium phosphate, and sodium bicarbonate solutions. When the post-galvanizing surface treatment is performed by immersion or spraying, in order to achieve the desired effect in a limited space and treating time, a strong alkali solution having a pH of at least 12, e.g., a 1M NaOH solution, is used preferably at a temperature of at least 50° C. and more preferably at least 60° C.

Post-galvanizing surface treatment can also be performed by electrolysis. The electrolysis may be either in the form of cathodic or anodic electrolysis in a strong alkali solution or a weak alkali solution (such as a sodium phosphate or sodium bicarbonate solution), or cathodic electrolysis in a neutral solution (such as a sodium sulfate solution). When performing electrolysis, a current can be directly applied between an electrode and the strip, or an alternating current can be indirectly applied to the strip. The temperature of the electrolytic solution is preferably at least 40° C. and more preferably at least 50° C.

Post-galvanizing surface treatment of the galvanized steel strip can also be performed by immersion or spraying with an acid which can dissolve aluminum oxide. Examples of useful acids include hydrofluoric acid, phosphoric acid, and oxalic acid. Sulfuric acid, hydrochloric acid, nitric acid, and the like have little ability to dissolve aluminum oxide, while they can dissolve the galvanized coating on the steel strip very rapidly, so they are not suitable. The acid preferably has a pH of 1–4 and a temperature of at least 40° C. and more preferably at least 50° C. If the pH is greater than 4, treatment requires a long time, while if the pH is less than 1, the dissolution of the galvanized coating is promoted, which is not desirable.

After the post-galvanizing surface treatment, the steel strip is rinsed with hot or cold water in a rinse tank 10 which may be a water scrubber or a dip tank. The remaining water can be removed from the surface of the strip using a ringer roll or an air blower. The galvanized steel strip can then be subjected to conventional skin-pass roller by passing through a skin-pass rolling mill 11 and a leveller 12.

Temper rolling prevents buckling of a hot-galvanized steel strip and removes strains caused by heating in the hot-galvanizing and alloying steps, and it flattens the surface of the galvanized coating. It can be performed with a reduction of 0.1–2.0%, for example. However, skin-pass rolling is not mandatory, and it can be omitted with certain types of steel strips, such as with Ti-containing steel strip. With normal steel strip, it is also possible to perform skin-pass rolling before the post-galvanizing surface treatment or subsequent to electroplating, as described above.

When a skin-pass rolling mill 11 is employed in a continuous plating line according to the present invention, the post-galvanizing surface treatment can be performed during the water cooling stage prior to skin-pass rolling using an alkali solution as a cooling medium.

After a steel strip is hot-galvanized and optionally alloyed, it is at a high temperature. On the other hand, from the standpoint of the mechanical properties of the steel strip, it is desirable that skin-pass rolling be performed in the vicinity of room temperature. Therefore, the galvanized steel strip is normally cooled to room temperature by water cooling prior to skin-pass rolling.

In one form of the present invention, an alkali solution is used as a cooling medium to perform cooling prior to skin-pass rolling, whereby the galvanized steel strip is cooled and simultaneously surface cleaning and activation of the galvanized coating can be performed. For this purpose, at least two cooling tanks are disposed before the skin-pass rolling mill. The cooling medium used in the last tank is water, but in at least one of the other tanks an alkaline solution is employed as a cooling medium and the galvanized steel strip is treated with the solution in that tank, thereby improving the microcovering power of the subsequent electroplating.

Figure 5:
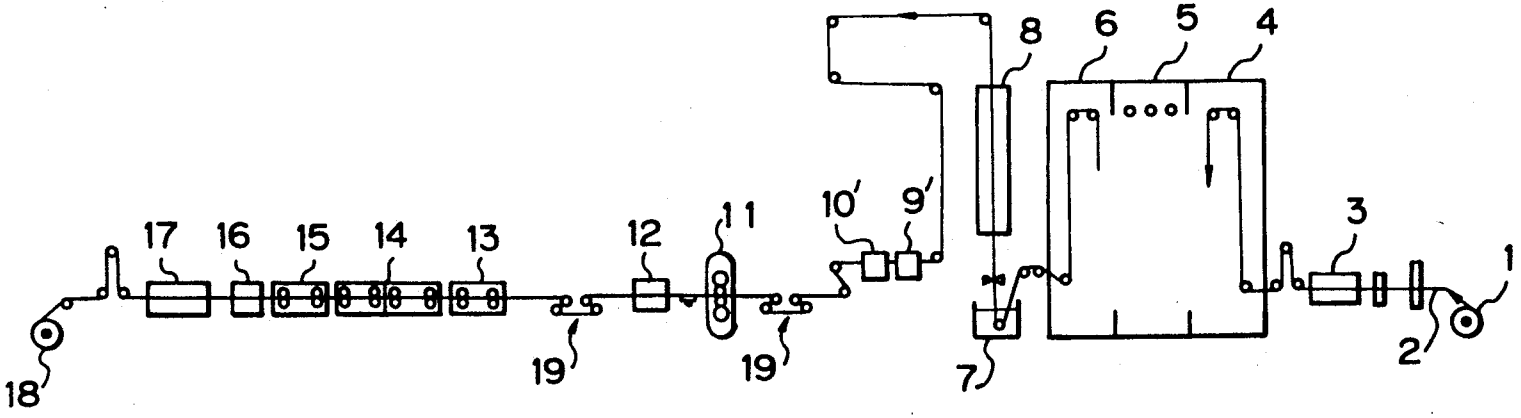
FIG. 5 is a schematic illustration of yet another embodiment of a continuous plating line according to the present invention.

FIG. 5 illustrates an embodiment of a continuous plating line according to this form of the present invention in which the post-galvanizing surface treatment apparatus comprises an alkali solution cooling tank 9' which is followed by a water cooling tank 10'. The structure of the plating line of this embodiment is otherwise the same as that of the embodiment of FIG. 1.

In the plating line of FIG. 5, a steel strip 2 which has been hot-galvanized and optionally alloyed and which is still hot is passed through the alkali solution cooling tank 9' in which the surface of the galvanized coating of the strip 2 is cooled and simultaneously cleaned and activated by immersing in or spraying with an alkali solution. The strip 2 is then passed through the water cooling tank 10' for rinsing and further cooling. The water rinsing in the final cooling tank 10' has no effect on the microcovering power of an electroplated coating, but it is merely to remove the alkali component adhering to the steel strip, thereby preventing the rolls and other equipment downstream of this tank from contamination and corrosion.

The alkali solution is typically formed from sodium hydroxide or potassium hydroxide, but other alkali compounds such as sodium carbonate, sodium bicarbonate, and sodium orthosilicate can also be employed. The alkali solution may also contain a surfactant. The pH of the alkali cooling solution is at least 10 in order to achieve the desired effect.

The temperature of the steel strip 2 at the entrance to the alkali solution cooling tank 9' is preferably at least 80° C. If the strip temperature falls below 80° C., it is necessary for the pH of the solution to be 12 or higher. Thus, by performing the post-galvanizing surface treatment during cooling of a hot alloyed or galvanized steel strip, the surface cleaning and activation of a galvanized coating is promoted due to the heat of the steel strip and can be accomplished in a short period with an alkali solution of a lower pH.

Figure 4:
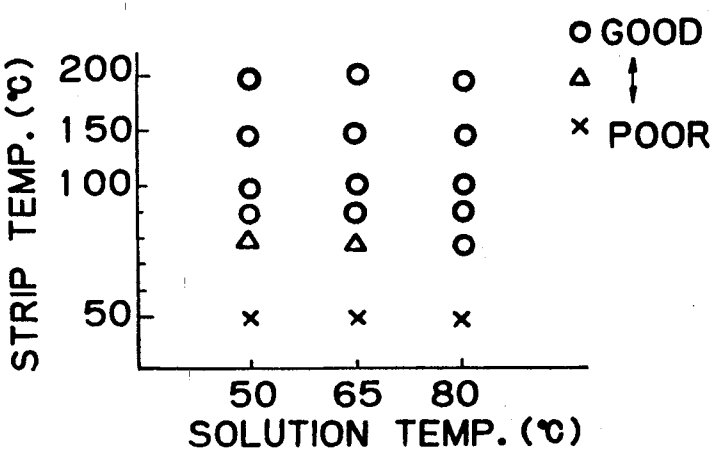
FIG. 4 is a graph of the relationship between the microcovering power of an electroplated coating, the temperature of a post-galvanizing surface treatment solution, and the temperature of a steel sheet during post-galvanizing surface treatment.

FIG. 4 shows the microcovering power of an electroplated coating when a hot-galvanized steel strip is treated with a sodium hydroxide solution of pH 10 for 1 second with different temperatures of the steel strip and the alkali solution. As can be seen from this figure, the microcovering power greatly depends on the strip temperature rather than the solution temperature. Accordingly, when the post-galvanizing surface treatment is performed in the cooling stage by using an alkali solution as a cooling medium immediately after the hot-galvanizing or alloying, the steel strip is still hot, usually at a temperature above 80° C., and the microcoverig power of an electroplated coating can be improved by treatment with an alkali solution having a lower pH of 10 or above.

When the post-galvanizing treatment with an alkali solution is performed after the galvanized steel strip has been cooled, it is undesirable to reheat the galvanized steel strip, particularly after skin-pass rolling, from the standpoint of maintaining the mechanical properties of the steel strip. Therefore, the alkali solution instead of the steel strip is heated. However, as mentioned above, the rise in solution temperature is less effective than that in strip temperature and it is preferable to use an alkali solution having a higher pH of at least 12.

According to another form of the present invention, the post-galvanizing surface treatment is performed during skin-pass rolling, using a strong alkali solution with a pH of at least 12 or an acid which can dissolve aluminum oxide as a skin-pass rolling liquid (lubricant).

Figure 3:
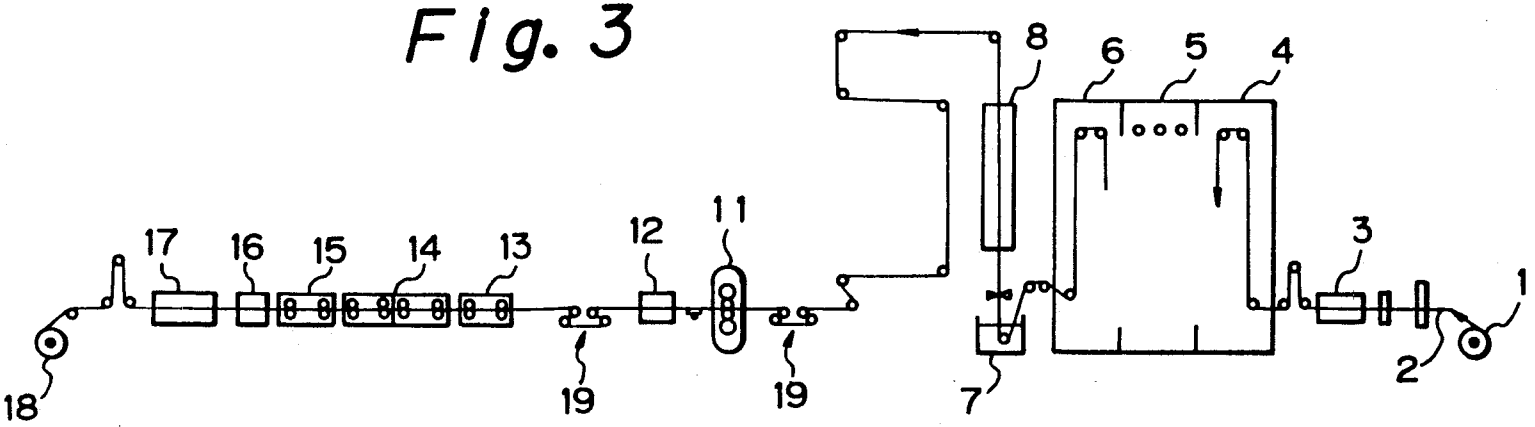
FIG. 3 is a schematic illustration of another embodiment of a continuous plating line according to the present invention.

FIG. 3 schematically illustrates an embodiment of a continuous plating line according to this form of the present invention in which the post-galvanizing surface treatment apparatus is in the form of a skin-pass rolling mill 11. If necessary, this embodiment can be further equipped with a water cooling tank (not shown) for cooling the steel strip 2 to a suitable temperature for skin-pass rolling.

An example of a strong alkali solution which can be used as a skin-pass rolling liquid is a 1M sodium hydroxide solution. However, any alkali solution can be used which does not adversely affect the subsequent electroplating when a minor amount thereof is introduced into the electroplating solution. A pH of at least 12 is effective, but when performing mass production, the pH is preferably at least 12.5.

Examples of acids which can dissolve aluminum oxide and which can be used as a skin-pass rolling liquid are as mentioned above and include hydrofluoric acid, phosphoric acid, and oxalic acid having a pH of 1–4.

The skin-pass rolling liquid formed from a strong alkali solution or an acid can be used by spraying onto the strip 2 or the work rolls of the skin-pass rolling mill. The treating time may be varied by the distance between the skin-pass rolling mill 11 and ringer rolls (not shown) downstream of the mill. The effectiveness of post-galvanizing surface treatment during skin-pass rolling is not significantly affected by manufacturing conditions such as the travelling speed of the steel strip or the roughness of skin-pass rolls. The temperature of the skin-pass rolling liquid is preferably at least 50° C.

It is known that an inhibitor may be added to water which is used as a skin-pass rolling liquid during temper rolling after hot galvanizing of a steel strip. However, the addition of an inhibitor is performed for the purpose of removing greases from the steel strip and for preventing corrosion. It has no effect on the microcovering power of an electroplated coating, and is thus totally different from the skin-pass rolling liquid which can be employed in the present invention.

A skin-pass rolling liquid in the form of a strong alkali with a pH of at least 12 or an acid which can dissolve aluminum oxide chemically removes surface oxide contaminants deposited on the galvanized coating which deteriorate the microcovering power of an electroplated coating formed thereon. At the same time, these contaminants are mechanically removed by the skin-pass rolling.

By performing the post-galvanizing surface treatment in one of the various above-mentioned methods prior to electroplating, the adhesion and covering power of the electroplated coating are greatly increased.

After the post-galvanizing surface treatment, the steel strip 2 is passed through an electroplating apparatus to deposite an electroplated coating on the galvanized coating. When both sides of the steel strip are galvanized, electroplating can be applied to either one or both sides. When galvanizing is performed on one side of the strip, usually electroplating is applied to the same side, i.e., on the glavanized coating, although there is no limitation in this respect.

The electroplating apparatus includes the pretreatment tank 13, the electroplating cell 14, and the washing tank 15 (a water scrubber). In the pretreatment tank 13, the galvanized steel strip 2 is washed with water which may contain a certain additive which improves the surface condition of the steel strip. In the electroplating cell 14, various types of electroplating can be performed. In the washing tank 15, the electroplated steel strip is rinsed with water. If necessary, the steel strip 2 can be dried with hot air or by electric heating in the drier 16.

The electroplated coating is not restricted to any particular type. For example, it can be one which improves coatability of the galvanized coating by cationic electrodeposition overlaid thereon such as a pure Fe or Fe-X coating (wherein X is Zn, P, Ni, B, Sn, Ti or the like), a coating which improves the sliding properties of the galvanized coating such as a Cr (Cr-oxide), Ni, Ni-Zn coating, or various dispersion-type coatings such as a Ni-SiC, Zn-$SiO_2$, Ni-Zn-$SiO_2$, or a Zn-$Al_2O_3$ coating. Depending on the desired coating weight, a plurality of electroplating cells can be used.

Next, if necessary, finishing surface treatment such as chromate treatment, zinc phosphate treatment, or resin coating using a roll coater can be performed in the finishing surface treatment apparatus 17 to obtain a finished product.

Normally, in an electroplating line, an alkali degreasing apparatus is installed as a pre-treatment apparatus. Such an apparatus is used merely for the purpose of removing dirt and grease (oil and fat) adhering to the steel strip, and its operation and effects are totally different from those of the post-galvanizing surface treatment employed in the present invention.

A hot-galvanized coating sometimes contains elements such as Al, Mg, and Mn. The post-galvanizing surface treatment of the present invention activates only the surface of the galvanized coating and does not reach the inside of the coating, so there is no adverse effect on these elements.

Figure 2:
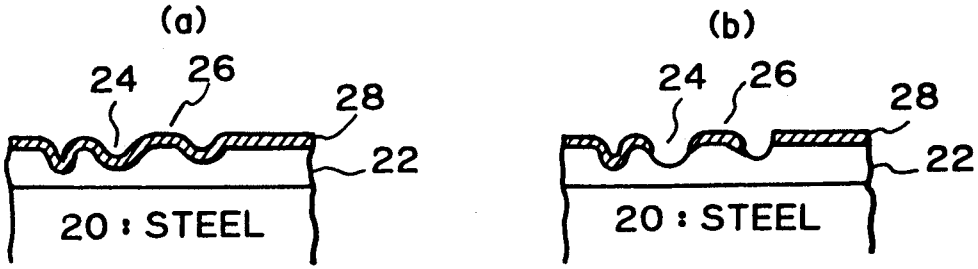
FIGS. 2*a* and 2*b* are schematic cross-sectional views of a multi-layer plated steel sheet manufactured by the method of the present invention and by a conventional method, respectively.

FIGS. 2*a* and 2*b* schematically illustrate the structure of a multi-layer coating according to the present invention and the prior art, respectively. In the example of the present invention (FIG. 2*a*), minute irregularities 24 and 26 can be observed in the alloyed hot-galvanized coating layer 22 formed on a steel strip 20, but an electroplated coating 28 is uniformly formed over the irregularities. Surface contaminants which obstruct electrodeposition are previously removed.

In contrast, in the example of the prior art (FIG. 2*b*), the electroplated coating layer 28 is able to cover the protrusions of the underlying alloyed galvanized coating 22, but the coating 22 is exposed where it contains depressions. Therefore, the coatability and workability of the resulting steel strip are not adequately improved by the electroplated coating.

EXAMPLES

The present invention will now be described in further detail by the following examples.

EXAMPLE 1

Continuous hot-galvanizing and electroplating were carried out using a continuous plating line like that illustrated in FIG. 1. The plating line was equipped with an additional post-galvanizing surface treatment apparatus between the leveller 12 and the bridle rolls 19 such that post-galvanizing surface treatment could be performed either before or after skin-pass rolling. Both sides of a steel strip were hot-galvanized with a coating weight of 45 g/$m^2$for each side and then alloyed. Post-galvanizing surface treatment was performed under the conditions given in Table 1 and after or before that the galvanized strip was temper-rolled using water which might contain a conventional inhibitor as a skin-pass rolling liquid. Electroplating was performed on both sides of the galvanized coating with a coating weight of 4 g/$m^2$ for each side. The plating conditions were otherwise normal ones.

In Table 1, A–F indicate the following treatment conditions.

(A) Immersion in an Alkaline Solution
alkali solution used: 2M NaOH solution
temperature: 70° C.
treatment time: 2 seconds.

(B) Alkali Electrolysis
alkali electrolytic solution: 1M NaOH solution
temperature: 70° C.
cathodic electrolysis: 20 A/$dm^2$
treatment time: 2 seconds.

(C) Neutral Cathodic Electrolysis
neutral electrolytic solution: 0.5M $Na_2SO_4$ solution
temperature: 70° C.
cathodic electrolysis: 60 A/$dm^2$
treatment time: 5 seconds.

(D) Spraying with an Alkaline Solution
spray solution: 1M NaOH solution
temperature: 70° C.
spray header pressure: 0.5 kg/$cm^2$
treatment time: 2 seconds.

(E) Immersion in an Acid
acid solution: 0.5M phosphoric acid solution
temperature: 70° C.
treatment time: 3 seconds.

(F) Spraying with an Acid
acid solution: 0.5M oxalic acid solution
temperature: 60° C.
treatment time: 3 seconds.

If necessary, chromate treatment was performed in a finishing surface treatment apparatus 17 after electroplating to obtain a finished product.

The adhesion and microcovering power of the electroplated coating are shown in Table 1.

The adhesion of the electroplated coating was measured by an adhesive tape peel test after the test piece was subjected to OT 180° bending. The microcovering power of the electroplated coating was evaluated by microscopic observation of a cross section and an EPMA (electron probe microanalyzer). The rating in these tests are as follows:

| | adhesion | microcovering power |
|---|---|---|
| ○ (good) | no peeling | complete covering over irregular surfaces |
| Δ (fair) | slight peeling | small uncovered areas |
| X (poor) | peeling | large uncovered areas |

TABLE 1

| No. | Galvanizing (under layer) | Electroplating (top layer) | Post-galvanizing treatment Type | Post-galvanizing treatment Location* | Electroplated coating Adhesion | Electroplated coating Microcovering power | Remarks |
|---|---|---|---|---|---|---|---|
| 1 | GI | Fe—Zn | — | — | X | Δ | Compar. |
| 2 | " | " | A | Before SPR | ○ | ○ | This |
| 3 | " | " | B | " | ○ | ○ | invention |
| 4 | " | " | C | " | ○ | ○ | |
| 5 | GA | Fe—Zn | — | — | Δ | X | Compar. |
| 6 | " | " | A | Before SPR | ○ | ○ | This |
| 7 | " | " | B | " | ○ | ○ | invention |
| 8 | " | " | C | " | ○ | ○ | |
| 9 | GA | Zn—Ni | — | — | Δ | X | Compar. |
| 10 | " | " | A | Before SPR | ○ | ○ | This |
| 11 | " | " | B | " | ○ | ○ | invention |
| 12 | GI | Fe—Zn | A | After SPR | ○ | ○ | |
| 13 | " | " | B | " | ○ | ○ | |
| 14 | " | " | C | " | ○ | ○ | |
| 15 | GA | Fe—Zn | A | After SPR | ○ | ○ | |
| 16 | " | " | B | " | ○ | ○ | |
| 17 | " | " | D | " | ○ | ○ | |
| 18 | GA | Zn—Ni | B | " | ○ | ○ | |
| 19 | GI | $Cr(CrO_x)$ | — | — | X | Δ | Compar. |
| 20 | " | " | B | After SPR | ○ | ○ | This |
| 21 | GA | Fe—Zn | E | Before SPR | ○ | ○ | invention |
| 22 | " | " | F | " | ○ | ○ | |
| 23 | GF (Zn-5% Al) | Fe—Zn | — | — | X | X | Compar. |
| 24 | GF (Zn-5% Al) | " | A | Before SPR | ○ | ○ | This invention |
| 25 | GF (Zn-5% Al) | " | E | " | ○ | ○ | |
| 26 | GL (Zn-55% Al) | Fe—Zn | — | — | X | X | Compar. |
| 27 | GL (Zn-55% Al) | " | A | Before SPR | ○ | ○ | This invention |
| 28 | GL (Zn-55% Al) | " | E | " | ○ | ○ | |

GI: galvanizing;
GA: alloyed galvanzing;
GF: GALFAN (alloy)
GL: GALVALUME (alloy).
A: Immersion in alkali solution;
B: alkali cathodic electrolysis;
C: neutral cathodic electrolysis;
D: spraying with alkali solution;
E: immersion in acid;
F: spraying with acid.
*SPR = skin pass rolling As is clear from Table 1, the electroplated coating of the resulting multi-layer plated steel strip according to the present invention had excellent adhesion and microcovering power. The microcovering power in particular was far superior to that of a conventional coating.

EXAMPLE 2

A 0.8 mm-thick GA (alloyed galvanized) steel strip having a galvanized coating of 45 g/m$^2$ on both sides which was manufactured by a commercial galvanizing line and which had not been treated with an oil or a chromate or other surface treatment solution was subjected to post-galvanizing surface treatment by immersion in various solutions shown in Table 2. Thereafter, Fe-Zn electroplating was performed on both sides under the following conditions. The microcovering power of the resulting electroplated coating was evaluated by microscopic observation of a cross section and an EPMA. The results are shown in Table 2. In Table 2, an ○ indicates that the plating was able to cover the irregularities in the GA layer as shown in FIG. 2*a*, while an × indicates that the electroplated layer was discontinuous as shown in FIG. 2*b*.

| Electroplating conditions: Sulfate bath: | |
|---|---|
| Total Fe: 80 g/l, | current density: 60 A/dm$^2$ |
| $Fe^{3+}$: 1000 ppm, | plating weight: 5 g/m$^2$ |
| $Zn^{2+}$: 2 g/l, | pH: 1.6 |
| $Na^{+}$: 2 g/l | Temperature: 50° C. |

TABLE 2

| No. | Immersion solution | pH | Temp. (°C.) | Treating Time (sec.) | Microcovering power |
|---|---|---|---|---|---|
| 1 | NaOH | 13.5 | 60 | 1 | ○ |
| 2 | NaOH | 12.5 | 60 | 1 | ○ |
| 3 | NaOH | 12.0 | 60 | 2 | ○ |
| 4 | NaOH | 11.0 | 60 | 2 | X |
| 5 | NaOH | 11.0 | 60 | 4 | X |
| 6 | HF | 3.0 | 60 | 2 | ○ |
| 7 | $H_3PO_4$ | 4.0 | 60 | 2 | ○ |
| 8 | Oxalic acid | 3.0 | 60 | 2 | ○ |
| 9 | $H_2SO_4$ | 3.0 | 60 | 2 | X |
| 10 | HCl | 3.0 | 60 | 2 | X |
| 11 | Thinner | — | 20 | 10 | X |
| 12 | Water | — | 60 | 4 | X |
| 13 | Water + Inhibitor | — | 60 | 4 | X |

For samples No. 4 and No. 5, the weak alkali treatment was carried out with a pH of less than 12, and samples No. 9 and 10 used an acid which could not dissolve aluminum oxide. Samples Nos. 11–13 illustrate conventional methods. In each of these samples, the aluminum oxide on the surface of the GA layer could not be dissolved and therefore the microcovering power was poor. In contrast, in samples Nos. 1–3 and 6–8 of the present invention, post-galvanizing surface treatment was able to dissolve the aluminum oxide on the surface of the GA coating without dissolving the GA coating itself, so the microcovering power was excellent.

EXAMPLE 3

Hot-galvanizing followed by electroplating was performed on both sides of a steel strip using an apparatus like that illustrated in FIG. 3. The coating weight of the galvanized Zn layer was 45 g/m$^2$ for each side. A 1M NaOH solution at a temperature of 50° C. with a pH of 13.5 was used as a skin-pass rolling liquid during skin-pass rolling of the alloyed galvanized strip which was performed with a reduction of 0.6%.

Continuous electroplating was carried out under the same conditions as for Example 2. The resulting plating had good microcovering power.

In contrast, when water (or water+an inhibitor) at 50° C. or when an NaOH solution with a pH of 11.0 was used as a skin-pass rolling liquid, the electroplated layer formed atop the GA coating had poor microcovering power.

EXAMPLE 4

An alloyed galvanized steel strip similar to that used in Example 2 was heated to various temperatures and treated for 1.0 second with an NaOH solution with a pH of 10.0 heated at various temperatures. The strip was then washed with water, after which it was electroplated under the following conditions. The effects of the temperatures of the alkali solution and the steel strip on the microcovering power of the resulting electroplated layer are shown in FIG. 4.

| Electroplating conditions | |
|---|---|
| Total Fe: 70 g/l | Current density: 50 A/dm$^2$ |
| $Fe^{3+}$: 2 g/l | Plating weight: 5 g/m$^2$ |
| $Zn^{2+}$: 1.5 g/l | Temperature: 50° C. |
| pH: 1.8 | |

It was confirmed that the temperature of the steel strip more greatly affected the microcovering power than the temperature of the alkali solution. The higher the temperature of the steel strip the better. Satisfactory results were obtained when the strip temperature is higher than 80° C.

EXAMPLE 5

An alloyed galvanized steel strip similar to that used in Example 2 was treated under the conditions shown in Table 3 and then washed with water. It was then electroplated under the same conditions as in Example 4.

The results are shown in Table 3.

TABLE 3

| No. | Immersion solution | pH | Solution temp. (°C.) | Strip temp. (°C.) | Treating time (sec.) | Micro-covering power |
|---|---|---|---|---|---|---|
| 1 | NaOH | 10 | 80 | 80 | 1.0 | ○ |
| 2 | NaOH | 10 | 80 | 100 | 0.5 | ○ |
| 3 | NaOH | 10 | 80 | 150 | 0.5 | ○ |
| 4 | NaOH | 10 | 80 | 200 | 0.5 | ○ |
| 5 | NaOH | 12 | 80 | 100 | 0.5 | ○ |
| 6 | NaOH | 9 | 80 | 100 | 1.0 | X |
| 7 | $Na_4SiO_4$ | 10 | 80 | 100 | 1.0 | ○ |
| 8 | Water | — | 80 | 150 | 1.0 | X |

The electroplated layer of the resulting multi-layer plated steel strip obtained by the method of the present invention had excellent microcovering power.

EXAMPLE 6

Using the apparatus shown in FIG. 5, an alloyed hot-galvanized steel strip was subjected to cooling using a NaOH solution with a pH of 10.0 as a cooling medium in an alkali solution cooling tank 9′ and then washed with water in a water cooling tank 10′. It was then electroplated under the same conditions as in Example 4. The alkali solution cooling conditions were as follows:

Strip temperature upon entry: 90° C.
Alkali solution temperature: 85° C.
Treatment time: 0.6 seconds.

The electroplated layer of the resulting multi-layer plated steel strip had good microcovering power.

For comparison, plating was carried out in the same manner as above except that alkali solution cooling was not performed. The resulting electroplated layer had poor microcovering power.

EXAMPLE 7

The procedure described in Example 2 was repeated except that the post-galvanizing surface treatment of a GA steel strip was performed by cathodic or anodic electrolysis under the conditions shown in Table 4. The electrolytic solutions used were a 1M sodium sulfate solution, a 1M ammonium chloride solution, both neutral, and a 1M sodium sulfate solution which had been adjusted to pH 11. The results are shown in Table 4.

TABLE 4

| | Electrolytic solution | Electrolysis conditions | Treat-ing time | Micro-covering power |
|---|---|---|---|---|
| 1 | 1M $Na_2SO_4$ (neutral, 50° C.) | Cathodic, 40 A/dm$^2$ | 2 sec | ○ |
| 2 | 1M $NH_4Cl$ (neutral, 50° C. | Cathodic, 40 A/dm$^2$ | 2 sec | ○ |
| 3 | 1M $Na_2SO_4$ (pH 11, 50° C.) | Cathodic, 40 A/dm$^2$ | 2 sec | ○ |
| 4 | 1M $Na_2SO_4$ (pH 11, 50° C.) | Anodic, 40 A/dm$^2$ | 2 sec | ○ |
| 5 | 1M $Na_2SO_4$ (neutral, 50° C.) | Anodic, 40 A/dm$^2$ | 2 sec | X |

From the preceding examples, it can be seen that by performing post-galvanizing surface treatment on a galvanized steel strip before electroplating according to the present invention, an electroplated coating having excellent adhesion and microcovering power can be obtained.

The principles, preferred embodiments and modes of operation of the present invention have been described in the foregoint specification. However, it is to be understood that variations and modifications may be employed without departing from the concept of the invention as defined in the following claims.

What is claimed is:

1. A continuous plating line for steel sheet comprising:

a continuous hot-galvanizing apparatus for forming a galvanized coating on at least one side of a steel sheet;

a continuous post-galvanizing surface treatment apparatus which is connected in series with the hot galvanizing apparatus and which is effective for removing surface oxide contaminants and activating the surface of the galvanized coating; and a continuous electroplating apparatus connected in series with the post-galvanizing surface treatment apparatus for forming an electroplated zinc alloy coating atop of the galvanized coating, the post-galvanizing surface treatment apparatus comprising an alkali electrolysis apparatus.

2. A continuous plating line for steel sheet comprising:

a continuous hot-galvanizing apparatus for forming a galvanized coating on at least one side of a steel sheet;

a continuous post-galvanizing surface treatment apparatus which is connected in series with the hot galvanizing apparatus and which is effective for removing surface oxide contaminants and activating the surface of the galvanized coating; and a continuous electroplating apparatus connected in series with the post-galvanizing surface treatment apparatus for forming an electroplated zinc alloy coating atop of the galvanized coating, the post-galvanizing surface treatment apparatus comprising a cathodic electrolysis apparatus.

3. A continuous plating line for steel sheet comprising:

a continuous hot-galvanizing apparatus for forming a galvanized coating on at least one side of a steel sheet;

a continuous post-galvanizing surface treatment apparatus which is connected in series with the hot galvanizing apparatus and which is effective for removing surface oxide contaminants and activating the surface of the galvanized coating, the post-galvanizing surface treatment apparatus comprising means for contacting the galvanized coating with an alkali solution; and a continuous electroplating apparatus connected in series with the post-galvanizing surface treatment apparatus for forming an electroplated zinc alloy coating atop of the galvanized coating;

the post-galvanizing surface treatment apparatus comprising a skin-pass rolling mill which is disposed between the hot-galvanizing apparatus and the electroplating apparatus and which uses an alkali solution with a pH of at least 12 which can dissolve aluminum oxide as a skin-pass rolling liquid.

4. A continuous plating line for steel sheet comprising:

a continuous hot-galvanizing apparatus for forming a galvanized coating on at least one side of a steel sheet;

a continuous post-galvanizing surface treatment apparatus which is connected in series with the hot galvanizing apparatus and which is effective for removing surface oxide contaminants and activating the surface of the galvanized coating;

a continuous electroplating apparatus connected in series with the post-galvanizing surface treatment apparatus for forming an electroplated zinc alloy coating atop of the galvanized coating;

a skin-pass rolling mill disposed between the hot-galvanizing apparatus and the electroplating apparatus; and a cooling tank disposed between the hot-galvanizing apparatus and the skin-pass rolling mill which uses an alkali solution with a pH of at least 10 as a cooling medium and which also serves as the post-galvanizing surface treatment apparatus.

5. A continuous plating line for steel sheet comprising:

a continuous hot-galvanizing apparatus for forming a galvanized coating on at least one side of a steel sheet;

a continuous post-galvanizing surface treatment apparatus which is connected in series with the hot galvanizing apparatus and which is effective for removing surface oxide contaminants and activating the surface of the galvanized coating;

a continuous electroplating apparatus connected in series with the post-galvanizing surface treatment apparatus for forming an electroplated zinc alloy coating atop of the galvanized coating; and an alloying furnace for alloying the galvanized coating.

6. In an electroplating method for hot-galvanized steel sheet, the improvement wherein the hot-galvanized steel sheet is subjected prior to electroplating to post-galvanizing surface treatment effective for removing surface oxide contaminants and activating the surface of the galvanized coating, the post-galvanizing surface treatment comprising applying an alkali solution having a pH of at least 12 to the surface of the galvanized coating, the alkali solution being applied by spraying.

7. In an electroplating method for hot-galvanized steel sheet, the improvement wherein the hot-galvanized steel sheet is subjected prior to electroplating to post-galvanizing surface treatment effective for removing surface oxide contaminants and activating the surface of the galvanized coating, the post-galvanizing surface treatment comprising electrolysis in an alkali electrolytic solution.

8. In an electroplating method for hot-galvanized steel sheet, the improvement wherein the hot-galvanized steel sheet is subjected prior to electroplating to post-galvanizing surface treatment effective for removing surface oxide contaminants and activating the surface of the galvanized coating, the post-galvanizing surface treatment comprising a cathodic electrolysis.

9. In an electroplating method for hot-galvanized steel sheet, the improvement wherein the hot-galvanized steel sheet is subjected prior to electroplating to post-galvanizing surface treatment effective for removing surface oxide contaminants and activating the surface of the galvanized coating, the post-galvanizing surface treatment comprising applying an acid which can dissolve aluminum oxide to the surface of the galvanized coating, the acid being applied by spraying.

10. In an electroplating method for hot-galvanized steel sheet, the improvement wherein the hot-galvanized steel sheet is subjected prior to electroplating with a zinc alloy to post-galvanizing surface treatment effective for removing surface oxide contaminants and activating the surface of the galvanized coating, the post-galvanizing surface treatment comprising contacting the surface of the galvanized coating with an alkali solution, the post-galvanizing surface treatment comprising skin-pass rolling using an alkali solution with a pH of at least 12 or an acid which can dissolve aluminum oxide as a skinpass rolling liquid.

11. In an electroplating method for hot-galvanized steel sheet, the improvement wherein the hot-galvanized steel sheet is subjected prior to electroplating to post-galvanizing surface treatment effective for removing surface oxide contaminants and activating the surface of the galvanized coating, the post-galvanizing surface treatment being performed on the hot-galvanized steel sheet which still remains at an elevated temperature by cooling the galvanized steel sheet with an alkali solution having a pH of at least 10.

12. An electroplating method as claimed in claim 11, wherein the temperature of the galvanized steel sheet when it is contacted with the alkali solution is at least 80° C.

13. An electroplating method as claimed in claim 11, wherein after the post-galvanizing surface treatment the galvanized steel sheet is rinsed with water and subjected to skin-pass rolling prior to electroplating.

* * * * *